US005779518A

United States Patent [19]

Schmitz

[11] Patent Number: 5,779,518

[45] Date of Patent: Jul. 14, 1998

[54] SUPERFINISHING METHOD AND APPARATUS

[75] Inventor: H. Guenter Schmitz, Wermelskirchen, Germany

[73] Assignee: Nagel Maschinen-und Werkzeugfabrik GmbH, Nuertingen, Germany

[21] Appl. No.: 616,710

[22] Filed: Mar. 15, 1996

[30] Foreign Application Priority Data

Mar. 17, 1995 [DE] Germany ..... 195 09 764.5

[51] Int. Cl.[6] ..... B24C 1/00

[52] U.S. Cl. ..... 451/28; 451/49

[58] Field of Search ..... 451/49, 28, 168, 451/51, 61, 10, 11, 50, 179, 165, 212, 272, 275, 162, 143, 381

[56] References Cited

U.S. PATENT DOCUMENTS

| | | | |
|---|---|---|---|
| 2,442,683 | 6/1948 | Green | 451/160 |
| 2,612,008 | 9/1952 | Kuniholm et al. | 451/51 |
| 2,647,348 | 8/1953 | Hahn | 451/51 |
| 2,680,941 | 6/1954 | Hahn | 451/143 |
| 3,535,828 | 10/1970 | Ware, Jr., et al. | 451/14 |
| 3,601,930 | 8/1971 | Robillard | 451/14 |
| 3,605,344 | 9/1971 | Hahn et al. | 451/14 |
| 3,803,772 | 4/1974 | Klar | 451/10 |
| 4,306,382 | 12/1981 | Ueda | 451/49 |
| 5,245,793 | 9/1993 | Schmitz | 451/49 |
| 5,384,983 | 1/1995 | Siggelin | 451/51 |

FOREIGN PATENT DOCUMENTS

| | | |
|---|---|---|
| 347847 | 12/1989 | European Pat. Off. . |
| 3930457 | 3/1991 | Germany . |
| 3940797 | 6/1991 | Germany . |

*Primary Examiner*—Timothy V. Eley
*Assistant Examiner*—Derris H. Banks
*Attorney, Agent, or Firm*—Quarles & Brady

[57] ABSTRACT

A method and apparatus for the superfinishing of workpieces, particularly workpieces driven in rotary manner with the aid of a superfinishing tool driven in rotary manner proposes that although the superfinishing tool is driven, it is held in fixed manner. Infeeding takes place solely through the infeeding movement of the workpiece to be worked, which leads to a greater rigidity of the apparatus and at the same time a very simple construction.

10 Claims, 4 Drawing Sheets

SUPERFINISHING METHOD AND APPARATUS

DESCRIPTION

Figure 1:
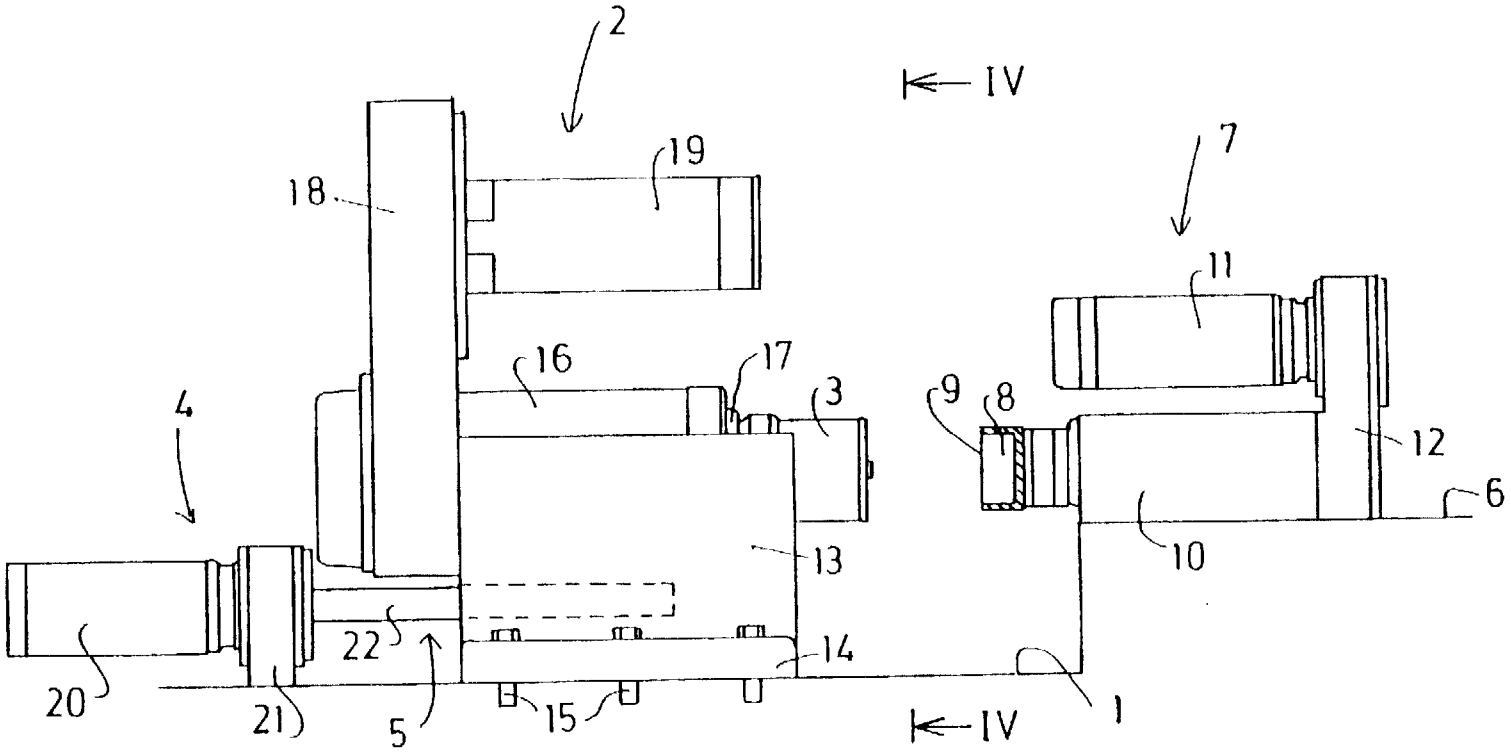

The invention relates to a method and an apparatus for the superfinishing of workpieces.

It is conventional practice with the apparatuses and methods according to the prior art for the workpiece, whose surface is to be worked, to be held in fixed manner and driven in rotary manner. Working takes place with the aid of a tool, which is moved substantially perpendicularly onto the workpiece surface to be worked, pressed or infed in a clearly defined manner. The tool is driven in addition to the infeed, e.g. in a vibratory or rotary movement.

This working operation is also called microfinishing and fine honing, but is described hereinafter solely by the term superfinishing.

In a known superfinishing apparatus, a component to be worked is driven in rotary manner and its surface to be worked is worked by a superfinishing tool which is also rotated (U.S. Pat. No. 5,245,793). For increasing the contact pressure or for resetting, the superfinishing tool can be reset in the direction of its rotation axis. It can also be moved in a direction perpendicular to the rotation axis in order to cover the entire surface to be worked.

Conventionally in the case of the known apparatuses the tool spindle is located in an adjustable casing, which is connected to an infeed slide, which additionally has a transverse adjustment slide. The tool spindle driven in rotary manner is so arranged that it can be adjusted in three directions.

So as to permit a minimum overall height for the infeedable tool spindle, said slides and infeed devices have a small size due to the limited space available. The infeed elements include hydraulic cylinders, ball roll spindles with nut and drive, etc. A high force application occurs in infeeding. The limited height, particularly of the bearing, is also due to the fact that the tool spindle has a high speed, which is much higher than that of the workpiece spindle. Thus, there is a no longer adequate stiffness or rigidity in the axial direction, i.e. the action direction of the superfinishing tool. Therefore it is only possible to operate with reduced cutting forces. If simultaneously several tools are used, which are arranged in juxtaposed manner, each tool spindle requires the aforementioned construction.

The problem of the invention is to provide a method and an apparatus for the superfinishing of workpieces which, in the case of a simple construction, permits a greater rigidity and therefore greater dimensional accuracy and/or allows increased cutting forces.

For solving this problem the invention proposes an apparatus having the features of claim 1 and a method having the features of claim 11.

In this case infeeding no longer takes place through a movement of the tool in the action direction, which is understood to mean the pressing direction, but instead by moving or infeeding the workpiece. On mounting the workpiece in the work support more space is available, so that the device for moving the workpiece can be made larger and more robust. This allows higher rigidities, whilst the tool mount, which is still to have a small overall height, also becomes more rigid due to the non-adjustability in the pressing direction.

Therefore the apparatus can be made more rigid and more simply, because no longer is it necessary to house so many elements in a very small space. The features of claim 2 can be provided for further developing the invention. They serve to give the workpiece a rotary movement if during superfinishing both the tool and the workpiece are to be driven in rotary manner. Due to the lower workpiece speed, the associated bearing can be made large.

According to a further development, the work mount can be constructed in such a way that the workpiece is moved in a direction perpendicular to the infeed direction. Thus, it would no longer be necessary to move the tool spindle, so that here again a rigidity increase can be obtained.

For moving the workpiece in a direction at right angles to the infeed direction a drive can be provided, so that the movement can take place automatically during working.

The superfinishing tools can not only be tools driven in rotary manner, but also those driven in a vibrating or oscillating manner. It is particularly favourable to use the invention in the case of superfinishing tools, which are driven in rotary manner and which have their action direction in the direction of the rotation axis thereof.

It is obviously also possible to construct the tool mount in such a way that it is displaceable in a direction perpendicular to the infeed direction.

According to a further development, the work mount has a frame fixable to a machine bed, with respect to which an infeedable work support-containing casing is displaceably guided. The frame can in particular be constructed in such a way that it surrounds in U-shaped manner the displaceable casing, so that here a very stable guide can be fitted. This guide can in particular have prismatic guides provided in clearance-free manner between the frame and the casing.

It has proved to be particularly advantageous of the infeed device has a ball roll spindle engaging in the work mount casing. This makes it possible to achieve a precise, highly loadable advance movement. The work support can in particular be constructed as a work spindle.

Further features, details and advantages can be gathered from the claims, whose wording is made by reference into the content of the description, the following description of a preferred embodiment of the invention and the attached drawings, wherein show:

FIG. 1 A diagrammatic side view of an apparatus according to the invention with a superfinishing tool drivable in rotary manner and a workpiece in a first position of the infeed device.

Figure 2:
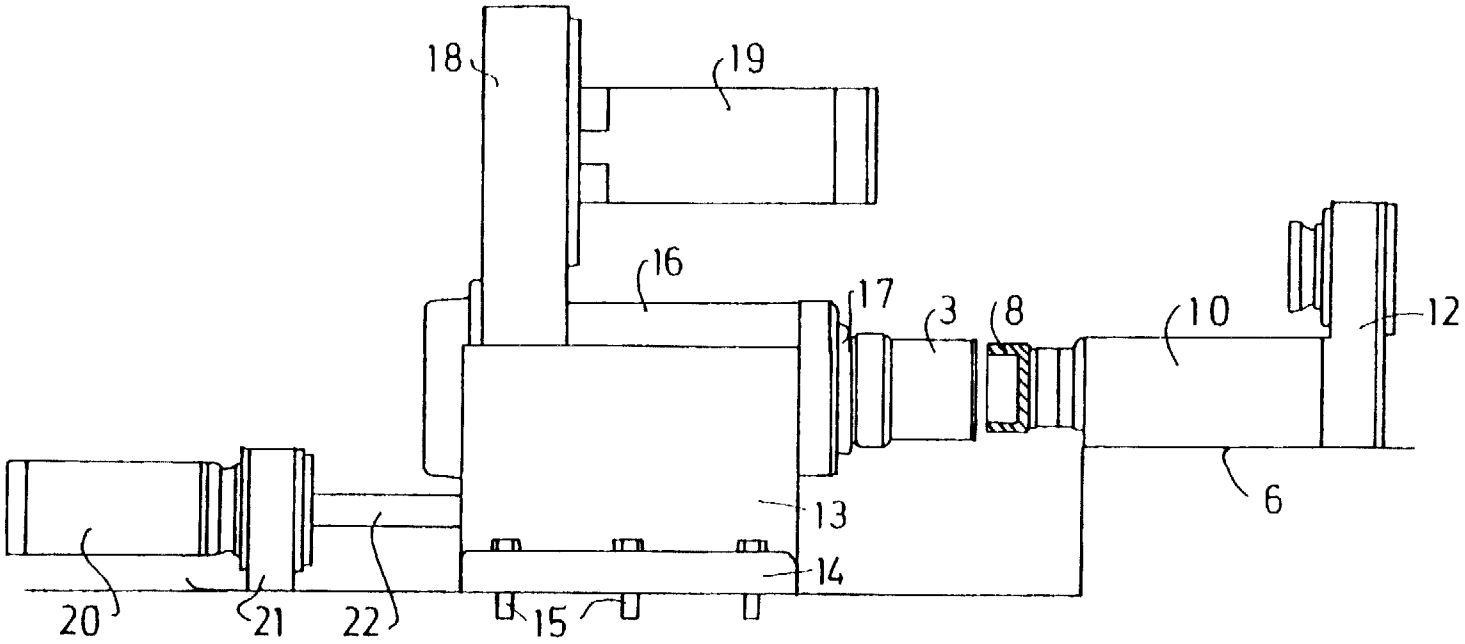

FIG. 2 A view corresponding to FIG. 1 with the workpiece in the infed position.

Figure 3:
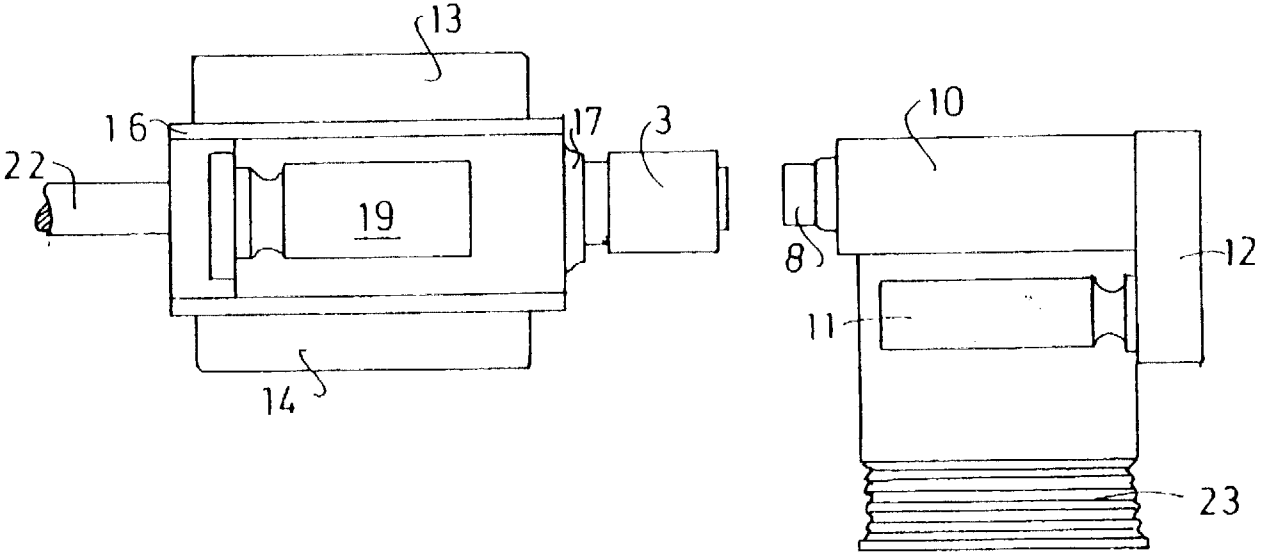

FIG. 3 Diagrammatically a plan view of the arrangement of FIGS. 1 and 2 in a central position.

Figure 4:
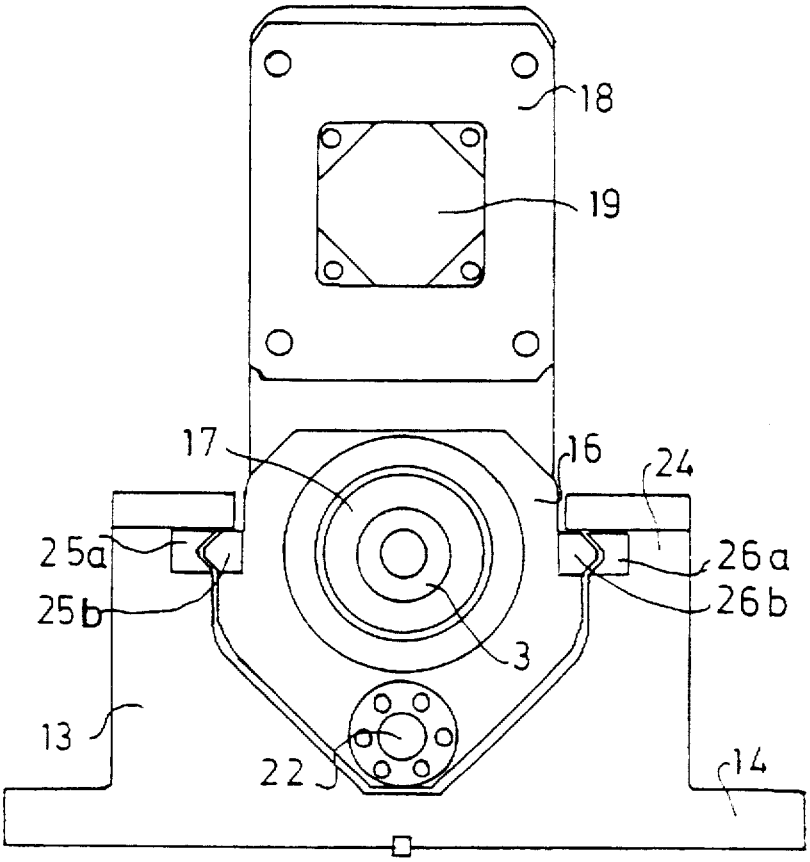

FIG. 4 An end view of the work mount roughly along line IV—IV in FIG. 1.

The apparatus shown in the drawings is mounted on a machine bed 1, to which is screwed a work support 2, in which is fixed a workpiece 3 to be worked. The said workpiece 3 can be moved to the right and then back to the left again with the aid of an infeed device 5 drivable by a drive 4 in FIG. 1.

To the right in FIG. 1, i.e. facing the work support 2, a tool mount 7 is placed on a step-like shoulder 6 of the machine bed 1 and in it is secured a superfinishing tool 8. The superfinishing tool 8 has a pot shape, the open side facing the workpiece 3. The end face 9 of this tool 8, which is a circular ring face, forms the actual working face of the superfinishing tool. The superfinishing tool 8 in the tool mount 7 is fixed in a tool spindle 10, which is driven by a tool drive 11. The tool drive 11 e.g. contains an electric motor which, by means of a gear 12, drives the tool spindle 10 and therefore the superfinishing tool 8. The work spindle 10 has a flat or shallow construction in its mount, so that it is arranged with a minimum spacing from the shoulder 6 of the machine bed 1.

The work support 2 contains a frame 13 provided with lateral flanges 14. The flanges 14 are screwed with the aid of screws 15 to the machine bed 1 for fixing the work support 2.

The work support contains a casing 16 in which is mounted in rotary manner a tool support 17 constructed as a tool spindle. In the tool support 17 is secured at its free end the workpiece 3 to be worked. To the casing 16 is fitted a gear box 18, to whose upper end remote from the machine bed is flanged a drive 19, preferably an electric motor. The drive 19 forms a rotary drive for the tool support 17 constructed as a spindle.

The drive 4 of the infeed device 5 contains a motor 20, e.g. an electric motor, which is fitted to a bearing 21 connected to the machine bed 1. It is used for driving a spindle 22, which engages in the casing 16 of the work support 2. An operation of the motor 20 leads to a rotation of the spindle 22 and consequently to a movement of the casing 16 of the work support 2 with respect to the fixed frame 13. The result of such a movement is illustrated in FIG. 2, where the tool support 2 is displaced on the workpiece 8 to just before the mutual engagement of tool and workpiece.

FIG. 3 shows in highly simplified form a plan view of the arrangement of FIGS. 1 and 2, to show that the drive 11 for the tool can also be positioned laterally with respect to the tool spindle casing 10. FIG. 3 illustrates by the bellows 23 that the casing 10 for the tool spindle can be moved from top to bottom and vice versa in FIG. 3, i.e. in a direction perpendicular to the rotation axis of the superfinishing tool 8 and parallel to the surface of the shoulder 6 of the machine bed 1.

FIG. 4 is a front view of the work mount. In an approximately U-shaped frame 13 (cf. also FIG. 1) is displaceably guided between the two legs 24 formed by the U-shape the work support casing 16. For guidance purposes there are two pairs of prismatic guide strips 25, 26, which form a highly loadable, sturdy guide for the casing 16. In the lower portion of the casing 16 the engagement of the ball roll spindle 22 is intimated. The drive motor 19 is flanged to the gear box 18.

The following method is performed with the above described and represented apparatus. In a position shown in FIG. 1, i.e. with the tool support remote from the tool, the workpiece can be inserted and secured in the work support 17. Then with the aid of the drive motor 19 the workpiece 3 and with the aid of the drive motor 11 the tool 8 are rotated and the workpiece is moved forwards by operating the infeed device 5 until reciprocal engagement occurs. The advance movement, which can take place in a regulated or controlled manner, is continued until the working of the end face of the workpiece 3 is ended. Optionally, during this working, there can be a movement of the superfinishing tool 8 in the indicated direction in the drawing plane of FIG. 3.

At the end of working the workpiece 3 with the work support is retracted and the rotary drive switched off. It can then be removed from the work support 17 again in the position shown in FIG. 1.

The apparatus according to the invention has a very robust construction, because for the guidance devices of the infeed device of the tool support more space is available than for the tool spindle.

I claim:

1. Apparatus for the superfinishing of workpieces having a work mount in which can be fixed a workpiece to be worked, the work mount having a frame fixable to a machine bed and with respect to which is displaceably guided an infeedable casing containing a work support;

a tool mount, in which can be fixed a superfinishing tool which is mounted in non-displaceable manner in an action direction of the tool;

a drive for the tool; and, an infeed device, which is so constructed that the infeed device can move the workpiece towards the tool in an infeed movement until the workpiece is at least in contact with said tool and has a drive.

2. Apparatus according to claim 1, wherein the work mount has the work support which is arranged in rotary manner and in which the workpiece can be secured, as well as a rotary drive for the work support.

3. Apparatus according to claim 2 wherein the work support (17) is constructed as a work spindle.

4. Apparatus according to claim 1, wherein the work mount is so constructed that it can move the workpiece in a direction perpendicular to an infeed direction of said infeed movement.

5. Apparatus according to claim 4 having a drive for moving the workpiece (3) in the second direction.

6. Apparatus according to claim 1, wherein the superfinishing tool (8) is driven in rotary manner and its action direction coincides with its rotation axis.

7. Apparatus according to claim 1, wherein the tool mount is so constructed that it is displaceable in a direction perpendicular to an infeed direction of said infeed movement.

8. Apparatus according to claim 1, wherein between the frame and the casing are provided guides, particularly prismatic guides.

9. Apparatus according to claim 1, wherein the infeed device has a ball roll spindle engaging in the casing of the work mount.

10. Method for the superfinishing of workpieces having a planar surface to be treated, wherein a superfinishing tool is driven in rotary manner about an axis, but is not moved in a direction along said axis, the workpiece to be worked is driven in rotary manner about a rotational axis and moved during the treatment at right angles to the rotational axis and towards the tool.

* * * * *